US007967626B2

(12) United States Patent
Nguyen et al.

(10) Patent No.: US 7,967,626 B2
(45) Date of Patent: Jun. 28, 2011

(54) TAMPER-EVIDENT CONNECTOR

(75) Inventors: Vincent Nguyen, Houston, TX (US); Chanh V. Hua, Houston, TX (US); Minh H. Nguyen, Katy, TX (US); E. David Neufeld, Magnolia, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/631,056

(22) Filed: Dec. 4, 2009

(65) Prior Publication Data

US 2010/0081311 A1 Apr. 1, 2010

Related U.S. Application Data

(62) Division of application No. 11/828,319, filed on Jul. 25, 2007, now Pat. No. 7,651,356.

(51) Int. Cl.
*H01R 13/62* (2006.01)

(52) U.S. Cl. ..... 439/301

(58) Field of Classification Search ..... 439/296, 439/301, 872, 876; 411/43; 713/300; 200/293; 340/652

See application file for complete search history.

(56) References Cited

U.S. PATENT DOCUMENTS

| | | | | |
|---|---|---|---|---|
| 3,808,588 | A | 4/1974 | McGregor | |
| 4,163,594 | A | 8/1979 | Augla | |
| 4,239,321 | A | 12/1980 | Bauer | |
| 4,406,507 | A * | 9/1983 | Eifler | 439/595 |
| 4,700,384 | A | 10/1987 | Meyer | |
| 4,990,888 | A | 2/1991 | Vogt et al. | |
| 5,556,295 | A | 9/1996 | McFadden et al. | |
| 5,785,541 | A | 7/1998 | Best | |
| 5,904,588 | A | 5/1999 | Nimura et al. | |
| 6,773,304 | B2 * | 8/2004 | Conway et al. | 439/595 |
| 7,033,193 | B2 | 4/2006 | Higgins | |
| 7,189,109 | B2 | 3/2007 | Robinson | |
| 7,317,401 | B2 * | 1/2008 | Germann et al. | 340/652 |
| 2006/0183357 | A1 | 8/2006 | Soh | |
| 2007/0253793 | A1 * | 11/2007 | Moore | 411/43 |

* cited by examiner

*Primary Examiner* — Alexander Gilman

(57) ABSTRACT

Embodiments of a tamper-evident connector are disclosed which may optionally be used in a trusted computing environment. In an exemplary embodiment, a tamper-evident connection includes a mate-once engaging assembly for providing with a first component, the mate-once engaging assembly including a foldable portion. The tamper-evident connection also includes a receiving chamber for providing with a second component, the mate-once engaging assembly fitting in the receiving chamber to physically secure the first component to the second component, the foldable portion of the mate-once engaging assembly unfolding during removal of the mate-once engaging assembly from the receiving chamber to provide evidence of tampering when the first component has been removed from the second component. Optionally, the first component is a Trusted Platform Module (TPM) and the second component is a system board.

15 Claims, 5 Drawing Sheets

TAMPER-EVIDENT CONNECTOR

CROSS-REFERENCE TO RELATED APPLICATIONS

This application is a divisional of U.S. application Ser. No. 11/828,319, filed Jul. 25, 2007 now U.S. Pat. No. 7,651,356, which is hereby incorporated by reference as though fully set forth herein.

BACKGROUND

In an unsecured computer environment, a computer application may access any available computing resources with little or no consideration given to whether those resources are secure. There are many reasons, however, that it is desirable to control access to computing resources.

The Trusted Computing Group (TCG) was formed and has adopted an industry standard specification to enhance the security of computing environments. The goal is to deliver an enhanced hardware and operating system (OS)-based trusted computing platform (TCP) for customers to run their applications. With regard to hardware considerations, a Trusted Platform Module (TPM) has been introduced which includes a micro-controller that stores security information. The TPM is the root of trust to create a secured environment that enables the OS and applications to fight against software attacks. TCG requires the TPM identification to be unique and to physically bind to a specific platform such that it can not be easily removed or transferred to another platform. Furthermore, the TPM must show evidence of physical tampering upon inspection.

Manufacturing platforms with the TPM increases the manufacturing costs. In addition, some countries (e.g., Russia and China) do not permit products to be shipped with security devices such as TPM. Accordingly, separate platforms without the TPM need to be manufactured and tracked (e.g., using unique SKU numbers) to be sold in these markets, thereby further increasing costs.

DETAILED DESCRIPTION

Briefly, embodiments of a tamper-evident connector are disclosed. The designs enable the TPM to be manufactured separately as an optional component, thereby reducing the cost of manufacturing separate system boards for different markets, while still meeting the TCG physical binding requirement (i.e., there is visible evidence of tampering if the TPM is removed). After removal, a malformed TPM likely cannot be reused (or is difficult to reuse) in another system thereby maintaining the integrity of the trusted software environment (TSE) if the TPM has already been compromised. However, the removal process does not affect the system board, thereby allowing an authorized administrator to replace the TPM module on the system board if needed.

Although the systems and methods described herein help to enable security measures for running trusted software and accessing trusted resources, it is noted that application of the tamper-evident connector is not limited to computer security. Still other applications of the tamper-evident connector will be readily apparent to those having ordinary skill in the art after becoming familiar with the teachings herein.

Figure 1:
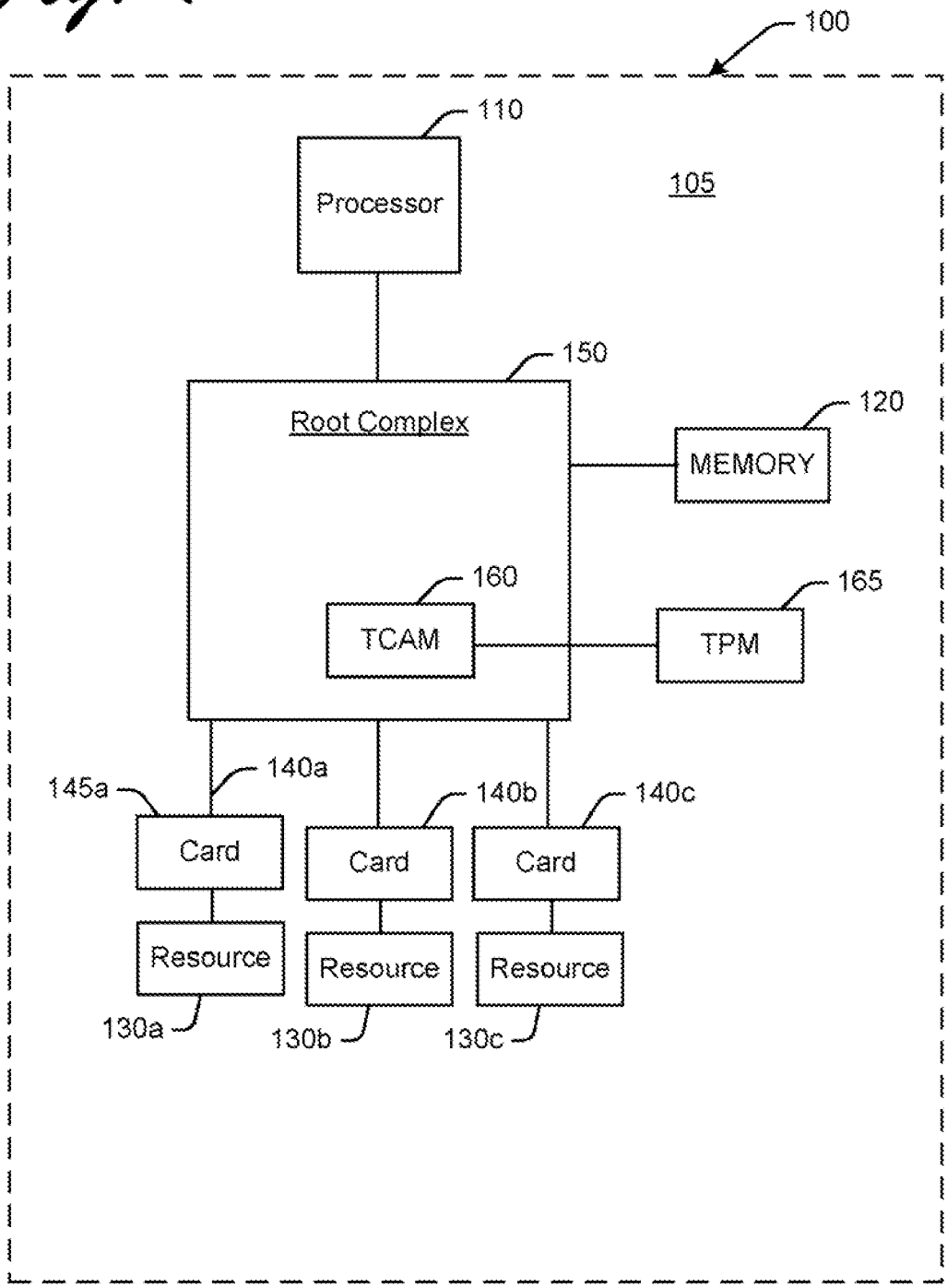
FIG. 1 is a high-level illustration of an exemplary trusted computing platform (TCP).

FIG. 1 is a high-level illustration of an exemplary trusted computing platform (TCP) 100. Exemplary TCP 100 may include one or more processors or processing units 110, and a system memory 120, such as, e.g., read only memory (ROM) and random access memory (RAM) on system board 105. Other memory may also be provided (e.g., local and/or remote, fixed and/or removable, magnetic and/or optical media). The memory provides storage of computer-readable instructions, data structures, program modules and other data for computing platform 100.

It is noted that computing platform 100 may operate as a stand-alone device and/or may operate in a networked computing environment using logical connections to one or more remote resources (not shown). The logical connections may include a local area network (LAN) and/or a wide area network (WAN). Exemplary remote resources include, but are not limited to, a personal computer, a server, a router, a network PC, and a peer device or other network node. Remote resources may include many or all of the elements described for the computing platform 100, such as, e.g., processing capability and memory.

Computing platform 100 may also include one or more resources 130*a-c*. As used herein, the term "resource" includes any of a wide variety of different types of devices (e.g., PCIe devices) and/or functions (e.g., provided by the device). In an exemplary embodiment, resources 130*a-c* may be communicatively coupled to the computing platform 100 via one or more peripheral component interconnect (PCI) links 140*a-b* implementing the PCI-express (PCIe) specification. In such an embodiment, the resources 130*a-c* may be connected directly to the root complex 150 via one or more PCIe cards 145*a-c*.

A host bridge and memory controller hub, also referred to generally as a root complex 150, couples the various system components to the processing unit 110. The root complex 150 is a subsystem which detects and initializes resources 130*a-c*, and manages the links 140*a-c* so that processor 110 can read/write to the resources 130*a-c* and/or otherwise control the resources 130*a-c*.

Computing platform 100 may operate in a protected or trusted operating environment. A trusted operating environment is a protected or secured environment for running trusted software and accessing trusted devices. Trusted software is software that has a reliably established notion of identity, e.g., indicating that the software is from a trusted source. A trusted device is a device accessible via a Trusted Configuration Access Mechanism (TCAM) 160. It is noted that there may be single or multiple TCAMs for each computing platform 100 (or for each partition on a computing platform).

Figure 3:
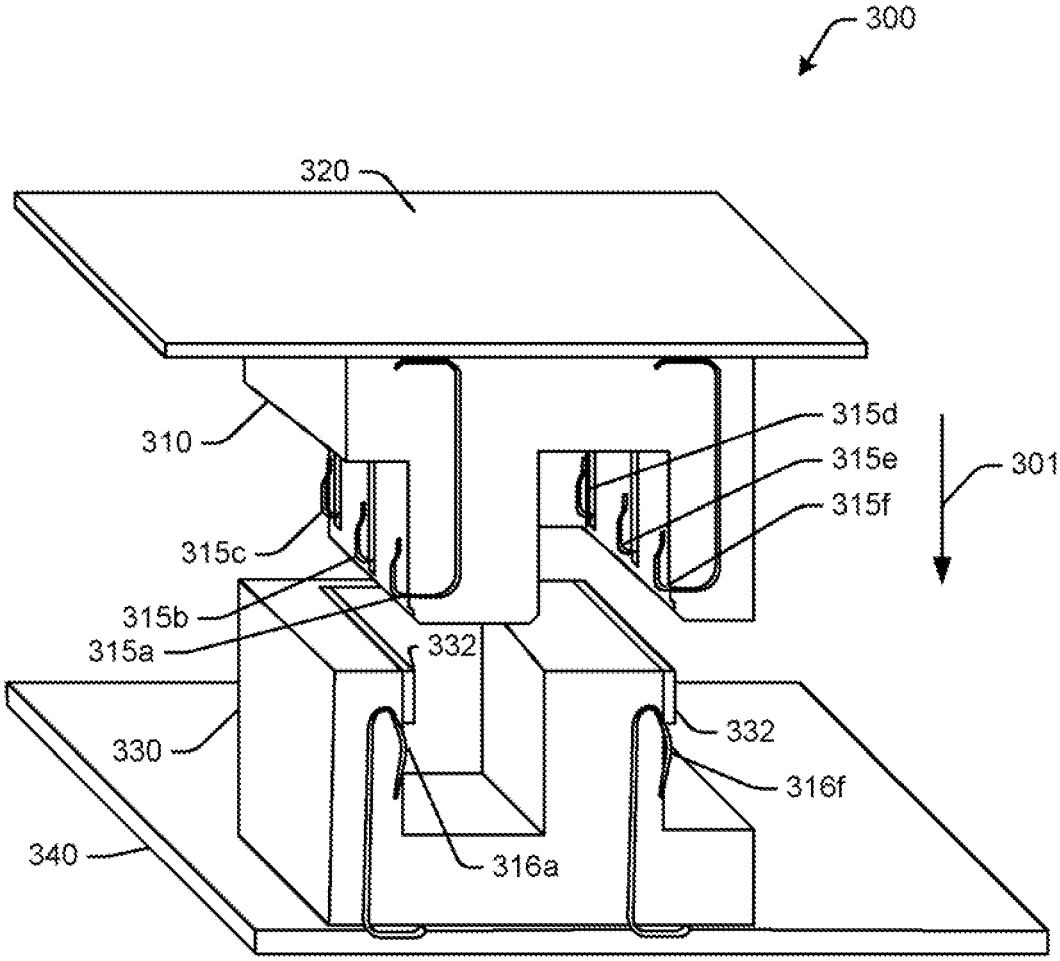
FIG. 3 is a perspective view of another exemplary tamper-evident connector which may be implemented in a TCP.

The TCAM 160 is patterned after the Enhanced Configuration Access Mechanism (ECAM) provided for the standard configuration space defined by the PCIe specification (e.g., the ECAM 340 in FIG. 3). Like the ECAM, the TCAM 160 also includes memory mapped regions, 1 mega-byte (MB) per bus number, base addresses and bus number ranges reported by firmware. Unlike the ECAM, however, the TCAM 160 is usable only by the trusted software, optionally only when enabled by hardware, such as, e.g., a trusted platform module (TPM) 165.

The TPM 165 provides protected storage, protected functions, authentication of the computing platform 100, measurement of platform integrity, and attestation of platform integrity. The TPM 165 may be implemented to assert a hardware signal that enables a TCAM 160 for use only if/when the platform integrity has been attested. The PCIe specification defines the TCAM, which then allows access to the trusted configuration registers via memory mapped address space, e.g., in memory 120.

The TPM 165 may be physically attached to the system board 105 by a tamper-evident connector. The tamper-evident connector provides visible evidence of tampering if the TPM 165 is removed from the system board 105 (e.g., in accordance with the TCG physical binding requirement). These and other features will be better understood by the description of exemplary embodiments of the tamper evident connector provided below with reference to FIGS. 2-3.

Figure 2:
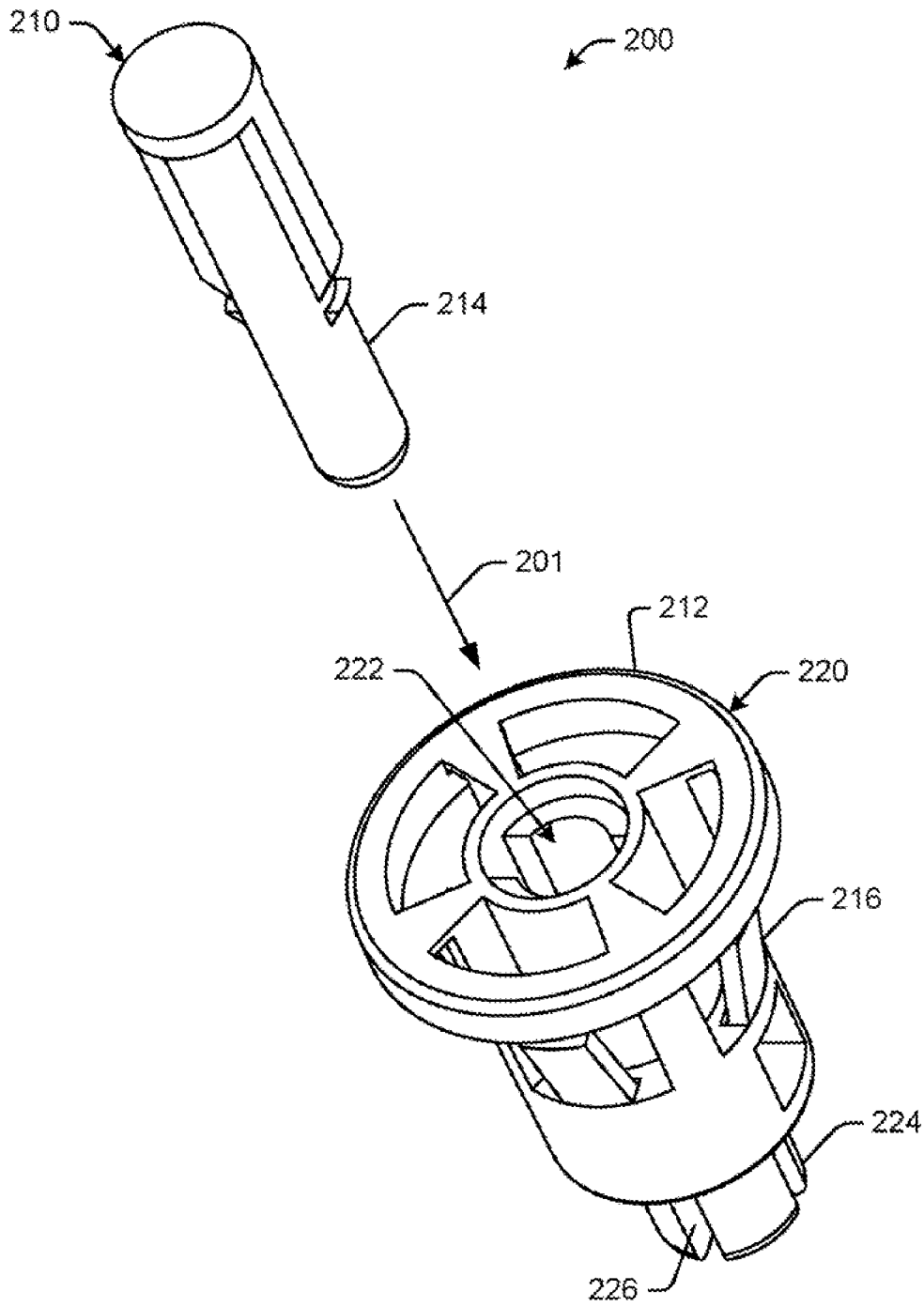
FIG. 2 is a perspective view of an exemplary tamper-evident connector which may be implemented in a TCP.

FIG. 2 is a perspective view of an exemplary tamper-evident connector which may be implemented in a TCP. In this embodiment, the tamper-evident connector is implemented as a mechanical binding rivet 200. The mechanical binding rivet 200 (or simply "rivet 200") may include a pin 210 having a head portion 212 and a body portion 214. The rivet 200 may also include an outer housing member 220 having a chamber portion 222 and an expandable portion 224.

When the rivet 200 is used in a secure computing environment, an electrical connector 230 may be mounted adjacent the pin 210 on a first component (e.g., TPM 240), and a second electrical connector 235 may be mounted adjacent the housing member 220 on a second component (e.g., system board 250). In an exemplary embodiment, the first electrical connector 230 and second electrical connector 235 may be commercially available 20-pin (or any number pin) mating electrical connectors. In any event, the electrical connectors 230 and 235 can be pushed together to form an electrical connection between the TPM 240 and the system board 250, e.g., for transferring security information from the TPM 240 to the system board 250.

Before continuing, it is noted that although shown as separate parts, the pin 210 and housing member 220 may be manufactured as a single part having the functionality of both pin 210 and housing member 220. For example, the rivet 200 may be manufactured so that it can be shipped with the pin 210 loosely connected to the housing member 220 so that the parts are less likely to get misplaced or otherwise lost. In addition, the electrical connectors 230 and 235 may also be integrated into the rivet 200 and do not need to be provided separately.

Figure 2A:
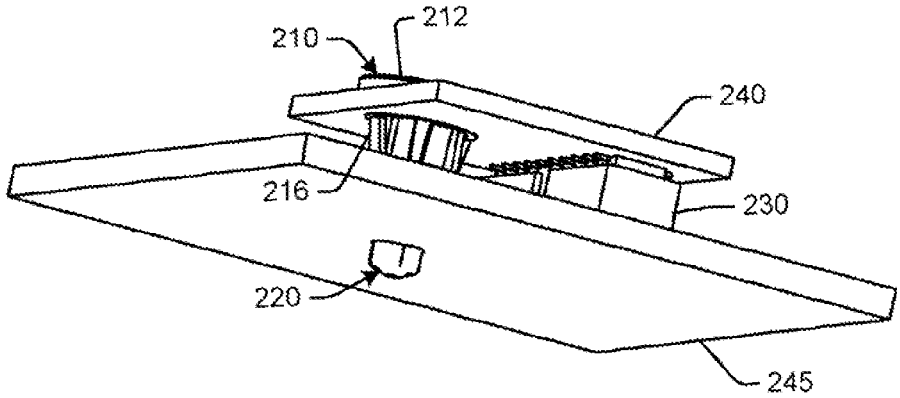
FIG. 2*a* is a perspective view of the exemplary tamper-evident connector in FIG. 2 shown mounted to a system board in the TCP.

FIG. 2*a* is a perspective view of the exemplary tamper-evident connector in FIG. 2 shown mounted to a system board in the TCP. In use, the body portion 214 of the pin 210 may be slid through an opening formed in TPM 240 until the head portion 212 abuts the surface of TPM 240. The head portion 212 of the pin 210 serves to stop the pin from sliding entirely through the TPM 240.

The housing member 220 may be fit into an opening 252 formed in the system board 250. For example, slots 226 in the expandable portion 224 of the housing member 220 enable the housing member 220 to reduce in size (e.g., a smaller diameter) when it is squeezed to fit through the opening 252. A spring-action naturally returns the expandable portion 224 to a widened state within the opening 252 to at least partially hold the housing member 220 in the system board 250.

When the body portion 214 of the pin 210 slides into the expandable portion 224 of the housing member 220, the presence of pin 210 forces the expandable portion 224 of the housing member 210 to further widen within the opening 252. Optionally, the pin 210 may be wider (or may include "fins" or other devices) at the end to enhance forcing the expandable portion 224 open. This widening action physically, and irreversibly, secures the TPM 240 to the system board 250.

Figure 2B:
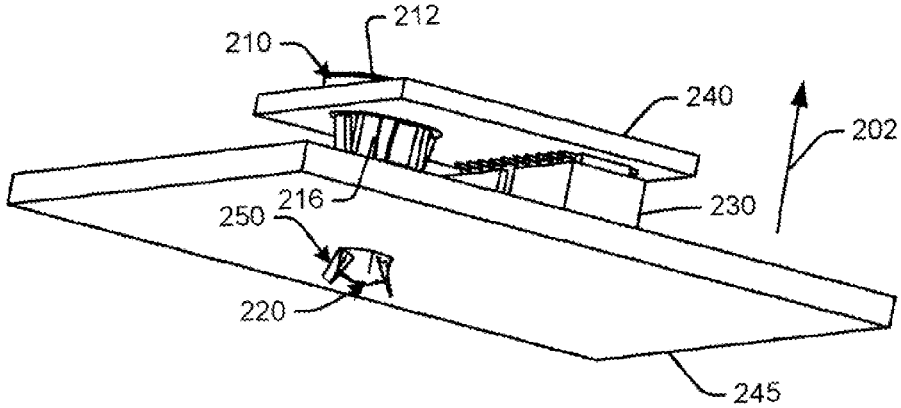
FIG. 2*b* is a perspective view of the exemplary tamper-evident connector in FIG. 2 after being removed from the system board.

FIG. 2*b* is a perspective view of the exemplary tamper-evident connector in FIG. 2 after being removed from the system board. Once connected, the electrical connection between electrical connectors 230 and 235 cannot be disconnected without removing the TPM 240 from the system board 250. However, in order for the TPM 240 to be removed from the system board 250, the expandable portion of the outer housing member must be broken apart to release the pin from the housing member, thereby providing visible evidence of tampering when the TPM 240 has been removed from the system board 250.

FIG. 3 is a perspective view of another exemplary tamper-evident connector which may be implemented in a TCP. In this embodiment, the tamper-evident connector is implemented as a "plug-type" connector 300. The plug-type connector (or simply "plug 300") may include a male block structure 310 for a first component (e.g., TPM 320), and a female block structure 330 for a second component (e.g., system board 340).

The male block structure 310 includes at least one foldable pin (and a plurality of foldable pins 315*a-c* are shown in FIG. 3), and the female block structure 330 includes a ledge portion 332. In an exemplary embodiment, the foldable pin(s) 315*a-c* are substantially hook-shaped or J-shaped, so that the foldable pins contact the ledge portion 332 when the male block structure 310 is fit into the female block structure 330 to physically secure the TPM 310 to the system board 340.

Figure 3A:
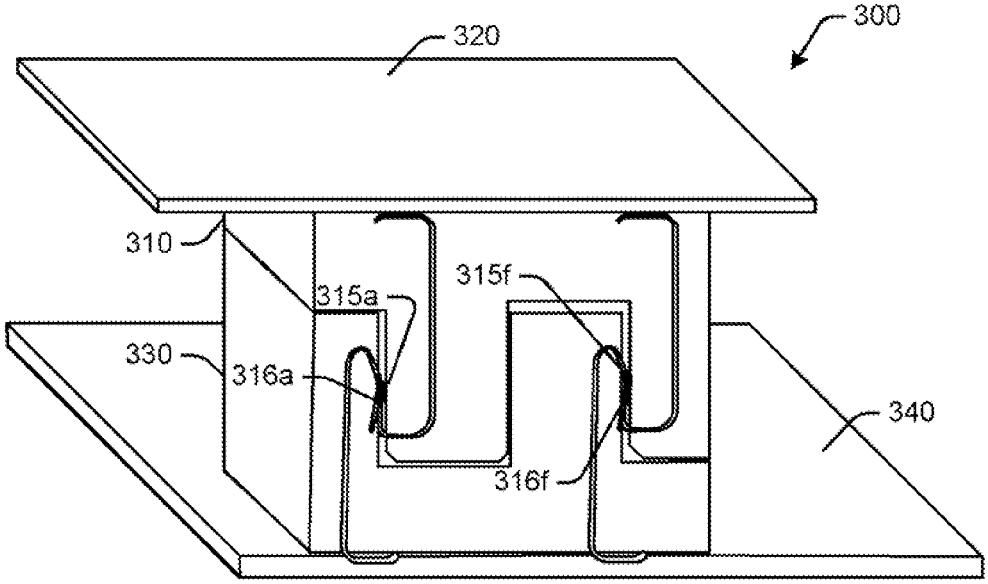
FIG. 3*a* is a perspective view of the exemplary tamper-evident connector in FIG. 3 shown mounted to a system board in the TCP.

FIG. 3*a* is a perspective view of the exemplary tamper-evident connector in FIG. 3 shown mounted to a system board in the TCP. When the plug 300 is used in a secure computing environment, the foldable pins 315*a-c* serve as an electrical connector, mating with pins 335 in the female block structure 330. Alternatively, separate electrical connections may be provided (e.g., integrated or adjacent the male and female block structures). When the male and female block structures 310 and 330 are connected to one another, an electrical connection is formed between the TPM 320 and the system board 340, e.g., for transferring security information from the TPM 320 to the system board 340.

Figure 3B:
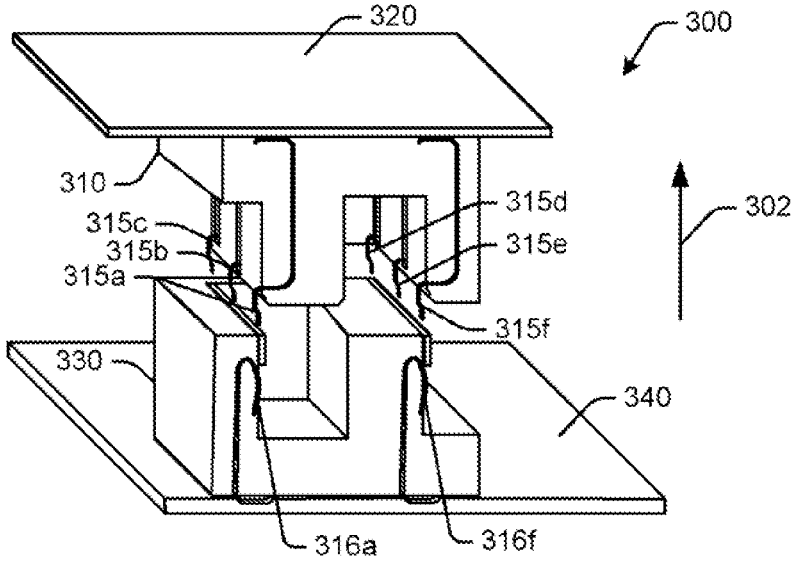
FIG. 3*b* is a perspective view of the exemplary tamper-evident connector in FIG. 3 after being removed from the system board.

FIG. 3*b* is a perspective view of the exemplary tamper-evident connector in FIG. 3. Once connected, the electrical connection cannot be disconnected without removing the TPM 320 from the system board 340. However, in order for the TPM 320 to be removed from the system board 340, the foldable pins 315*a-c* are pulled by the ledge portion 332 and unfold during as the male block structure 310 is pulled apart from the female block structure 330. This provides visible evidence of tampering when the TPM 320 has been removed from the system board 340.

It is noted that with regard to any of the embodiments of the tamper-evident connector described above, TPM installation (the initial binding process) may be performed by the system integrator during manufacturing by the original design manufacturer (ODM) or at customer sites. The use of tools is not necessary for the initial binding process, making the tamper-evident connector easy to use.

After removal, a malformed TPM likely cannot be reused (or is difficult to reuse) in another system thereby maintaining the integrity of the trusted software environment (TSE) if the TPM has already been compromised. However, the removal process does not affect the system board, thereby allowing an authorized administrator to replace the TPM module on the system board if needed, e.g., for servicing or replacement.

It is noted that the exemplary embodiments shown in the Figures and discussed above are provided for purposes of illustration. In addition to the specific embodiments explicitly set forth herein, other aspects and embodiments will be apparent to those skilled in the art from consideration of the specification disclosed herein. It is intended that the specification and illustrated embodiments be considered as examples only.

The invention claimed is:

1. A tamper-evident connector comprising:

a pin having a head portion and a body portion, the body portion for sliding through a first component until stopped by the head portion abutting the first component;

an outer housing member having a chamber portion and an expandable portion, the body portion fitting into a second component; and the body portion of the pin configured to slide through the chamber portion and into the expandable portion of the outer housing member, the pin expanding the expandable portion to physically secure the first component to the second component, the expandable portion of the outer housing member needing to break apart in order to release the pin from the housing member to provide visible evidence of tampering when the first component has been removed from the second component.

2. The tamper-evident connector of claim 1 wherein the first component is a TPM and the second component is a system board.

3. The tamper-evident connector of claim 1 further comprising a spacer portion on the housing member to physically secure the first component to the second component at a predetermined spacing.

4. The tamper-evident connector of claim 1 further comprising a first electrical connector mounted adjacent the pin on the first component and a second electrical connector mounted adjacent the outer housing on the second component to form an electrical connection between the first component and the second component.

5. The tamper-evident connector of claim 4 wherein the electrical connection is for transferring security information.

6. The tamper-evident connector of claim 1, wherein the pin includes fins at one end to enhance forcing the expandable portion open.

7. A tamper-evident connector for use in secure computing environments, comprising:

a mate-once engaging assembly for a TPM; and a receiving chamber for a system board, the mate-once engaging assembly expanding the receiving chamber to physically secure the TPM to the system board;

fins at one end of the mate-once engaging assembly to enhance forcing open an expandable portion of the receiving chamber; and a breakable portion providing visible evidence of tampering if the TPM is removed from the system board.

8. The tamper-evident connector of claim 7 further comprising a first electrical connector on the TPM and a second electrical connector on the system board to form an electrical connection when the TPM is physically secured to the system board.

9. The tamper-evident connector of claim 8 wherein the electrical connection is for transferring security information from the TPM to the system board.

10. A tamper-evident connector comprising:

a pin having a head portion and a body portion, the body portion for sliding through a system board until stopped by the head portion, wherein the pin includes fins at one end to enhance forcing the expandable portion open; and a housing member having a chamber portion and an expandable portion, the housing member having slots in an expandable portion of the housing member, the housing member fitting into an opening formed in the system board and the slots in the expandable portion of the housing member reducing the housing member to a smaller diameter when the housing member is squeezed to fit through the opening, and a spring-action naturally returning the expandable portion to a widened state within the opening to at least partially hold the housing member in the system board.

11. The connector of claim 10 wherein the housing member needs to break apart in order to release the pin from the housing member to provide visible evidence of tampering when a TPM attached to the connector has been removed from the system board.

12. The connector of claim 10 wherein the pin forces the expandable portion of the housing member to further widen within the opening when the body portion of the pin slides into the expandable portion of the housing member.

13. The connector of claim 10 wherein the pin is wider at one end to enhance forcing the expandable portion open.

14. The connector of claim 10 wherein after removal, a malformed TPM cannot be reused in another system thereby maintaining the integrity of a trusted software environment (TSE).

15. The connector of claim 10 wherein removal of the TPM does not affect the system board, thereby allowing replacement of the TPM.

* * * * *